United States Patent [19]

Momoki

[11] Patent Number: 4,892,809

[45] Date of Patent: Jan. 9, 1990

[54] SILVER HALIDE PHOTOGRAPHIC MATERIALS

[75] Inventor: Yasuhito Momoki, Minami-ashigara, Japan

[73] Assignee: Fuji Photo Film Co., Ltd., Kanagawa, Japan

[21] Appl. No.: 351,273

[22] Filed: May 11, 1989

Related U.S. Application Data

[63] Continuation of Ser. No. 909,232, Sep. 19, 1986, abandoned.

[30] Foreign Application Priority Data

Sep. 20, 1985 [JP] Japan ..... 60-208313

[51] Int. Cl.[4] ..... G03C 7/38

[52] U.S. Cl. ..... 430/550; 430/551; 430/558; 430/600; 430/603; 430/607; 430/614; 430/569

[58] Field of Search ..... 430/550, 551, 600, 603, 430/607, 614, 558, 569

[56] References Cited

U.S. PATENT DOCUMENTS

| | | | |
|---|---|---|---|
| 2,273,562 | 2/1942 | Davey et al. | 430/614 |
| 3,982,948 | 9/1976 | Sato et al. | 430/614 |
| 4,590,153 | 5/1986 | Kawagishi et al. | 430/558 |

*Primary Examiner*—Paul R. Michl
*Assistant Examiner*—Mark R. Buscher
*Attorney, Agent, or Firm*—Birch, Stewart, Kolasch & Birch

[57] ABSTRACT

A silver halide color photographic material having at least one silver halide emulsion layer on a base, in which the emulsion layer contains at least one kind of specific magenta coupler of a pyrazoloazole system and the silver halide emulsion is a silver chlorobromide emulsion or silver chloroiodobromide emulsion chemically sensitized in the presence of a nucleic acid or a decomposition product thereof prior to the completion of chemical sensitization by sulfur compounds. This color photographic material is improved in color reproduction and image stability, less liable to fogging that is formed during development, and less dependent on processing conditions.

13 Claims, No Drawings

SILVER HALIDE PHOTOGRAPHIC MATERIALS

This application is a continuation of application Ser. No. 06/909,232 filed on September 19, 1986, now abandoned.

BACKGROUND OF THE INVENTION

1. Field of the Invention:

The present invention relates to a silver halide color photographic material, and more particularly, it relates to a silver halide color photographic material which is improved in color reproduction and image stability, less liable to fogging that is formed during development, and less dependent on processing conditions.

2. Description of the Prior Art:

In order to form a photographic image, photosensitive layers respectively containing yellow, magenta, and cyan couplers are, after exposure, processed with a developing solution containing a color developing agent. In the process of color development, the oxidation product of an aromatic primary amine combines with the couplers to form image dyes through coupling reaction. Desirable couplers are ones which undergo the coupling reaction at a rate as high as possible and provide a high color density within the limited development time. In addition, the dyes thus formed are required to be bright cyan, magenta, and yellow dyes having less subsidiary absorption to provide color photographic images with good color reproduction.

On the other hand, the color photographic images thus formed are required to be stable under various preservation conditions because they are sensitive to moisture, heat, and light. Besides discoloration and fading, the yellowing of the white background is of vital importance to photographic color images.

The coupler as the color image forming substance plays a great role in satisfying the above-mentioned requirements for color photographic materials. Heretofore, there were proposed many variations in the structure of the coupler to improve their properties. Significant among them is the improvement on the conventional 5-pyrazolone derivatives as the magenta coupler important from the standpoint of luminosity.

One disadvantage of the conventional pyrazolone derivatives was that they formed images which had undesirable absorption in the blue and red spectral regions as well as the desired absorption in the green spectral region. In addition, they formed images which easily caused yellowing upon exposure to light or high humidity during preservation.

Another disadvantage of 5-pyrazolone derivatives was that they easily caused so-called magenta fogging at the time of development. To eliminate this disadvantage, there was proposed a silver halide color photographic material in which 3-anilino-5-pyrazolone coupler was combined with a silver halide emulsion incorporated with a decomposition product of nucleic acid prior to the completion of chemical ripening (Japanese Patent Publication No. 50978/1984). With this photographic material, however, the above-mentioned disadvantage of 5-pyrazolone derivatives (undesirable absorption in the blue and red spectral regions and yellowing upon exposure to light and preservation under high humidity) was not completely overcome. In the case of this photographic material, the magenta fogging is suppressed to some extent if the development was performed at a comparatively low temperature, but the fog itself was excessive when the development temperature was higher than 33° C. and was not suppressed effectively.

In order to overcome the above-mentioned disadvantage of the conventional color photographic material, the inventors carried out a series of research, which led to the finding that the object is achieved by a silver halide color photosensitive material which contains a pyrazoloazole-system magenta coupler represented by Formula (I) below and a silver halide emulsion chemically sensitized under the coexistence of a nucleic acid or a decomposition product thereof prior to the completion of chemical sensitization by sulfur compounds. This photographic material is superior in color reproduction and image stability, less liable to fogging that is formed during development, and less dependent on processing conditions (especially development temperature). In addition, this photographic material solved the problem of yellowing. The present invention was completed on the basis of this finding.

SUMMARY OF THE INVENTION

An object of the present invention is to provide a silver halide color photographic material which provides a color image with improved color reproducibility and improved image stability.

Another object of the present invention is to provide a silver halide color photographic material which is less liable to magenta fogging during development.

A further object of the present invention is to provide a silver halide color photographic material which provides a color image less dependent on processing conditions.

A still further object of the present invention is to provide a silver halide color photographic material which provides a color image with white background improved in yellowing.

Other and further objects, features and advantages of the invention will appear more fully from the following description.

DETAILED DESCRIPTION OF THE INVENTION

According to the present invention, there is provided a silver halide color photosensitive material having at least one silver halide emulsion layer on a base, characterized in that said emulsion layer contains at least one kind of pyrazoloazole system magenta coupler represented by Formula (I) below and said silver halide emulsion is a silver chlorobromide emulsion or silver chloroiodobromide emulsion chemically sensitized by adding a nucleic acid or a decomposition product thereof prior to the completion of chemical sensitization by sulfur compounds.

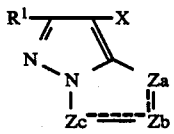

Formula (I)

wherein $R^1$ represents a hydrogen atom or substituent; X represents a hydrogen atom or a group which can be split-off upon coupling reaction with the oxidation product of an aromatic primary amine as a developing agent; Za, Zb, and Zc each represent a methine, substituted methine, =N—, or —NH—; one of Za-Zb bond and Zb-Zc bond is a double bond and the other is a single bond; and if Zb-Zc bond is a carbon-carbon double bond, it may be a part of an aromatic ring. The magenta coupler may be a dimer or polymer formed by connecting through $R^1$ or X. If Za, Zb, or Zc is a substituted methine, the magenta coupler may also be a dimer or polymer formed by connecting through the substituted methine.

According to the present invention, the silver halide emulsion in the silver halide emulsion layer is chemically sensitized under the coexistence of a nucleic acid or a decomposition product thereof prior to the completion of chemical sensitization. The chemical sensitization should be sulfur sensitization, but it may be combined with reduction sensitization, gold sensitization, or the like.

If such a chemical sensitization as reduction sensitization and gold sensitization is carried out alone without sulfur sensitization, the effect owing to the coexistence of a nucleic acid or a decomposition product thereof on the suppression of magenta fogging is insignificant, and the object of the invention can not be achieved. The definition "prior to the completion of chemical sensitization" means the time when silver halide particles are formed, the time when physical ripening is performed, or the time when chemical ripening (chemical sensitization) is performed.

In this invention, the chemical sensitization by sulfur compounds is performed by using a sulfur compound reactive to active gelatin and silver (e.g., thiosulfates, thioureas, mercapto compounds, and rhodanines). Examples of these compounds are described in U.S. Pat. Nos. 1,574,944, 2,278,947, 2,410,689, 2,728,668, and 3,656,955.

The nucleic acid used in this invention includes deoxyribonucleic acid (DNA) and ribonucleic acid (RNA). The decomposition product of the nucleic acid includes partially-decomposed nucleic acids and simple substances such as adenine, guanine, uracil, cytosine, and thymine. Among these, adenine is a preferred example of the decomposition products of nucleic acid. They may be used individually or in combination with one another. It goes without saying that a nucleic acid can be used in combination with a decomposition product of a nucleic acid. The amount of a nucleic acid or a decomposition product thereof to be added varies depending on their kinds, and it is more than 20 mg, preferably 100 mg to 1 g, per mole of said silver halide. This also applies to the total amount of nucleic acids and decomposition products thereof which are used in combination with one another.

According to this invention, the silver halide emulsion for chemical sensitization by sulfur compounds includes silver chlorobromide emulsion and silver chloroiodobromide emulsion. In the present invention the chlorine atoms included as the halogen atom of silver halide are especially responsible for high development speed and good photographic processing performance. The silver chlorobromide or silver chloroiodobromide preferably contains at least 1 mol % of silver chloride. In the case of silver chloroiodobromide, the content of silver iodide is preferably less than 2 mol %.

The term "polymer" used in connection with the compound represented by Formula (I) means those compounds which have in one molecule two or more groups represented by Formula (I). Such compounds include dimer and polymer couplers. The polymer coupler may be a homopolymer composed solely of a monomer component having the moiety represented by Formula (I) (preferably monomers having a vinyl group [referred to as vinyl monomer hereinafter]). The polymer coupler may also be a copolymer containing a non-color-developing ethylenic monomer which does not undergo coupling with the oxidation product of an aromatic primary amine.

Preferable examples of the pyrazoloazole system magenta coupler represented by Formula (I) includes those represented by Formulas (II) to (VIII) below.

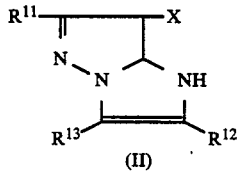
(II)

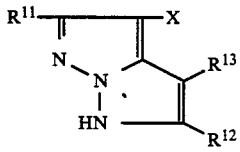
(III)

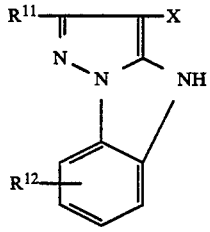
(IV)

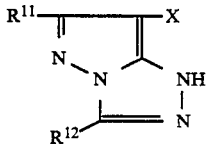
(V)

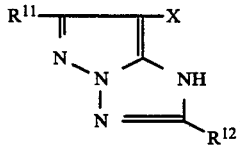
(VI)

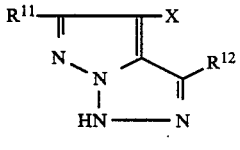
(VII)

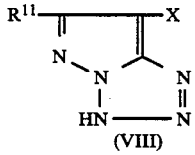
(VIII)

Among the couplers represented by Formulas (II) to (VIII), those represented by Formulas (II), (V), and (VI) are more preferable for the object of the invention, and the one represented by Formula (VI) is most preferable.

In Formulas (II) to (VIII), $R^{11}$, $R^{12}$, and $R^{13}$, which may be the same or different from one another, independently represent a hydrogen atom, halogen atom, alkyl group, aryl group, heterocyclic group, cyano group, alkoxyl group, aryloxy group, heterocyclic oxy group, acyloxy group, carbamoyloxy group, silyloxy group, sulfonyloxy group, acylamino group, anilino group, ureido group, imide group, sulfamoylamino group, carbamoylamino group, alkylthio group, arylthio group, heterocyclic thio group, alkoxycarbonylamino group, aryloxycarbonylamino group, sulfonamide group, carbamoyl group, acyl group, sulfamoyl group, sulfonyl group, sulfinyl group, alkoxycarbonyl group, and aryloxycarbonyl group; and X represents a hydrogen atom, halogen atom, carboxyl group, or a coupling split-off group combined with a carbon at the coupling position through an oxygen atom, nitrogen atom, or sulfur atom, $R^{11}$, $R^{12}$, $R^{13}$, or X may be a divalent group to form a bis compound.

The coupler may be in the form of polymer coupler in which the coupler residue represented by Formulas (II) to (VIII) is on the principal chain or side chain of the polymer. The preferred polymer is derived from a vinyl monomer having the moiety represented by Formulas (I) to (VIII). In this case, $R^{11}$, $R^{12}$, $R^{13}$, or X represents a vinyl group or a connecting group.

To be more specific, $R^{11}$, $R^{12}$, and $R^{13}$ each represents a hydrogen atom, halogen atom (e.g., chlorine atom and bromine atom), alkyl group (e.g., methyl group, propyl group, isopropyl group, t-butyl group, trifluoromethyl group, tridecyl group, 2-[α-{3-(2-octyloxy-5-tert-octylbenzenesulfonamido)phenoxy}tetradecanamido]ethyl group, 3-(2,4-di-t-amylphenoxy)-propyl group, allyl group, 2-dodecyloxyethyl group, 1-(2-octyloxy-5-tert-octylbenzenesulfonamido)-2-propyl group, 1-ethyl-1-{4-(2-butoxy-5-tert-octylbenzenesulfonamido)phenyl}methyl group, 3-phenoxypropyl group, 2-hexylsulfonyl-ethyl group, cyclopentyl group, and benzyl group), aryl group (e.g., phenyl group, 4-t-butylphenyl group, 2,4-di-t-amylphenyl group, and 4-tetradecanamidophenyl group), heterocyclic group (e.g., 2-furyl group, 2-thienyl group, 2-pyrimidyl group, and 2-benzothiazolyl group), cyano group, alkoxy group (e.g., methoxy group, ethoxy group, 2-methoxyethoxy group, 2-dodecyloxyethoxy group, and 2-methanesulfonylethoxy group), aryloxy group (e.g., phenoxy group, 2-methylphenoxy group, and 4-t-butylphenoxy group), heterocyclic oxy group (e.g., 2-benzimidazolyloxy group), acyloxy group (e.g., acetoxy group and hexadecanoyloxy group), carbamoyloxy group (e.g., N-phenylcarbamoyloxy group and N-ethylcarbamoyloxy group), silyloxy group (e.g., trimethylsilyloxy group), sulfonyloxy group (e.g., dodecylsulfonyloxy group), acylamino group (e.g., acetamido group, benzamido group, tetradecanamido group, α-(2,4-di-t-amylphenoxy)butylamido group, γ-(3-t-butyl-4-hydroxyphenoxy)butylamido group, and α-{4-(4-hydroxyphenylsulfonyl)phenoxy}decanamido group), anilino group (e.g., phenylamino group, 2-chloroanilino group, 2-chloro-5-tetradecanamidoanilino group, 2-chloro-5-dodecyloxycarbonylanilino group, N-acetylanilino group, and 2-chloro-5-{α-(3-t-butyl-4-hydroxyphenoxy)-dodecanamido}anilino group), ureido group (e.g., phenylureido group, methylureido group, and N,N-dibutylureido group), imido group (e.g., N-succinimido group, 3-benzylhydantoinyl group, and 4-(2-ethylhexanoylamino)phthalimido group), sulfamoylamino group (e.g., N,N-dipropylsulfamoylamino group and N-methyl-decylsulfamoylamino group), alkylthio group (e.g., methylthio group, octylthio group, tetradecylthio group, 2-phenoxyethylthio group, 3-phenoxypropylthio group, and 3-(4-t-butylphenoxy)propylthio group), arylthio group (e.g., phenylthio group, 2-butoxy-5-t-octylphenylthio group, 3-pentadecylphenylthio group, 2-carboxyphenylthio group, and 4-tetradecanamidophenylthio group), heterocyclic thio group (e.g., 2-benzothiazolylthio group), alkoxycarbonylamino group (e.g., methoxycarbonylamino group and tetradecyloxycarbonylamino group), aryloxycarbonylamino group (e.g., phenoxycarbonylamino group, 2,4-di-tert-butylphenoxycarbonylamino group), sulfonamido group (e.g., metasulfonamido group, hexadecanesulfonamido group, benzenesulfonamido group, p-toluenesulfonamido group, octadecanesulfonamido group, and 2-methyloxy-5-t-butylbenzenesulfonamido group), carbamoyl group (e.g., N-ethylcarbamoyl group, N,N-dibutylcarbamoyl group, N-(2-dodecyloxyethyl)carbamoyl group, N-methyl-N-dodecylcarbamoyl group, and N-{3-(2,4-di-tert-amylphenoxy)propyl}carbamoyl group), acyl group (e.g., acetyl group, (2,4-di-tert-amylphenoxy)acetyl group, and benzoyl group), sulfamoyl group (e.g., N-ethylsulfamoyl group, N,N-dipropylsulfamoyl group, N-(2-dodecyloxyethyl)sulfamoyl group, N-ethyl-N-dodecylsulfamoyl group, and N,N-diethylsulfamoyl group), sulfonyl group (e.g., methanesulfonyl group, octanesulfonyl group, benzenesulfonyl group, and toluenesulfonyl group), sulfinyl group (e.g., octanesulfinyl group, dodecylsulfinyl group, and phenylsulfinyl group), alkoxycarbonyl group (e.g., methoxycarbonyl group, butyloxycarbonyl group, dodecylcarbonyl group, and octadecylcarbonyl group), and aryloxycarbonyl group (e.g., phenyloxycarbonyl group and 3-pentadecyloxycarbonyl group).

X represents a hydrogen atom, halogen atom (e.g., chlorine atom, bromine atom, and iodine atom), carboxyl group, group connected through an oxygen atom (e.g., acetoxy group, propanoyloxy group, benzoyloxy group, 2,4-dichlorobenzoyloxy group, ethoxyoxazoyloxy group, pyruvinyloxy group, cinnamoyloxy group, phenoxy group, 4-cyanophenoxy group, 4-methanesulfonamidophenoxy group, 4-methanesulfonylphenoxy group, α-naphthoxy, 3-pentadecylphenoxy group, benzyloxycarbonyloxy group, ethoxy group, 2-cyanoethoxy group, benzyloxy group, 2-phenetyloxy group, 2-phenoxyethoxy group, 5-phenyltetrazolyloxy group, and 2-benzothiazolyloxy group), group connected through a nitrogen atom (e.g., benzenesulfonamido group, N-ethyltoluenesulfonamido group, heptafluorobutanamido group, 2,3,4,5,6-pentafluorobenzamido group, octanesulfonamido group, p-cyanophenylureido group, N,N-diethylsulfamoylamino group, 1-piperidyl group, 5,5-dimethyl-2,4-dioxo-3-oxazolydinyl group, 1-benzyl-ethoxy-3-hydantoinyl group, 2N-1,1-dioxy-3(2H)-oxo-1,2-benzoisothiazolyl group, 2-oxo-1,2-dihydro-1-pyridinyl group, imidazolyl group, pyrazolyl group, 3,5-diethyl-1,2,4-triazol-1-yl group, 5- or 6-bromobenzotriazol-1-yl group, 5-methyl-1,2,3,4-triazol-1-yl group, benzimidazolyl group, 3-benzyl-1-hydantoinyl group, 1-benzyl-5-hexadecyloxy-3-hydantoinyl group, and 5-methyl-1-tetrazolyl group), arylazo group (e.g., 4-methoxyphenylazo group, 4-pivaloylaminophenylazo group, 2-naphthylazo group, and 3-methyl-4-hydroxyphenylazo group), and group connected through a sulfur atom (e.g., phenylthio group, 2-carboxyphenylthio group, 2-methoxy-5-t-octylphenylthio group, 4-methanesulfonylthio group, 4-octanesulfonamidophenylthio group, 2-butoxyphenylthio group, 2-(2-hexanesulfonylethyl)-5-tert-octylphenylthio group, benzylthio group, 2-cyanoethylthio group, 1-ethoxycarbonyltridecylthio group, 5-phenyl-2,3,4,5-tetrazolylthio group, 2-benzothiazolylthio group, 2-dodecylthio-5-thiophenylthio group, and 2-phenyl-3-dodecyl-1,2,4-triazole-5-thio group).

In the case of couplers represented by Formulas (II) and (III), $R^{12}$ and $R^{13}$ may join to form a 5-to 7-membered ring.

In the case where $R^{11}$, $R^{12}$, $R^{13}$, or X is a divalent group to form dimer, $R^{11}$, $R^{12}$, and $R^{13}$ independently represent a substituted or unsubstituted alkylene group (e.g., methylene group, ethylene group, 1,10-decylene group, and $—CH_2CH_2—O—CH_2CH_2—$), substituted or unsubstituted phenylene group (e.g., 1,4-phenylene group, 1,3-phenylene group, and groups represented by the formulas below).

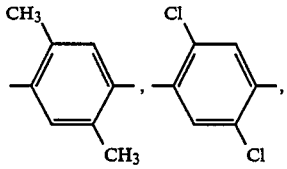

etc., —NHCO—$R^{14}$—CONH— group [wherein $R^{14}$ represents a substituted or unsubstituted alkylene group or phenylene group] such as —$NHCOCH_2CH_2CONH$—,

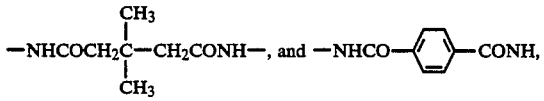

—S—$R^{14}$—S— group [wherein $R^{14}$ represents a substituted or unsubstituted alkylene group] such as —S—$CH_2CH_2$—S— and

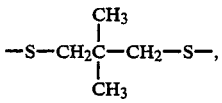

and X represents a divalent group derived from the above-mentioned monovalent group.

In the case where the compound represent by Formulas (II) to (VIII) is contained in a vinyl monomer, examples of the connecting group represented by $R^{11}$, $R^{12}$, $R^{13}$, and X include those groups selected from substituted or unsubstituted alkylene groups (e.g., methylene group, ethylene group, 1,10-decylene group, and —$CH_2CH_2OCH_2CH_2$—), substituted or unsubstituted phenylene groups (e.g., 1,4-phenylene group, 1,3-phenylene group, and

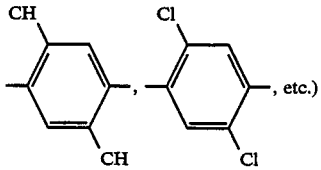

—NHCO—, CONH—, —O—, —OCO—, and aralkylene group (e.g.,

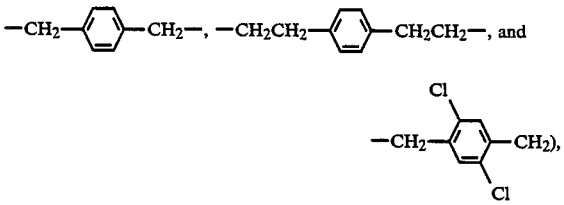

and combination thereof.

Preferred connecting groups are as follows:

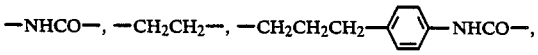

-continued

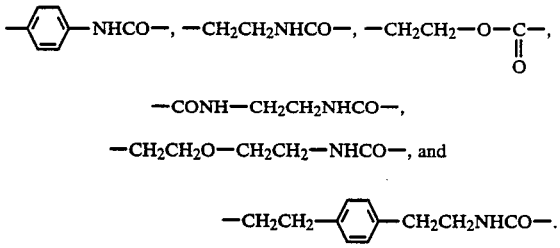

The vinyl group may have a substituent group other than the group represented by Formulas (II) to (VIII). The preferred substituent group is a hydrogen atom, chlorine atom, or lower alkyl group having 1 to 4 carbon atoms (e.g., methyl group and ethyl group).

The monomer containing the group represented by Formulas (II) to (VIII) may form a copolymer with a non-colordeveloping ethylenic monomer which does not undergo coupling with the oxidation product of an aromatic primary amine developing agent.

Examples of the non-colordeveloping ethylenic monomer, which does not undergo coupling with the oxidation product of an aromatic primary amine developing agent, include acrylic acid, α-chloroacrylic acid, α-alkylacrylic acid (e.g., methacylic acid), ester or amide derived therefrom (e.g., acrylamide, n-butylacrylamide, t-butylacrylamide, diacetoneacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butylmethacrylate, and β-hydroxy methacrylate), methylene dibisacrylamide, vinyl ester (e.g., vinyl acetate, vinyl propionate, vinyl laurate), acrylonitrile, methacrylonitrile, aromatic vinyl compound (e.g., styrene and derivatives thereof, vinyltoluene, divinylbenzene, vinylacetophenone, and sulfostyrene), itaconic acid, citraconic acid, crotonic acid, vinylidene chloride, vinyl alkyl ether (e.g., vinyl ethyl ether), maleic acid, maleic anhydride, maleate ester, N-vinyl-2-pyrrolidone, N-vinylpyridine, and 2- and 4-vinylpyridine. The non-colordeveloping ethylenic unsaturated monomer may be used in combination with one another. Examples of the combination include n-butyl acrylate and methyl acrylate, styrene and methacrylic acid, methacrylic acid and acrylamide, and methyl acrylate and diacetoneacrylamide.

As known well in the field of polymer color coupler, the non-colordeveloping ethylenic unsaturated monomer to be copolymerized with a solid water-insoluble monomer coupler may be selected so that it favorably affects the physical and/or chemical properties (e.g., solubility) of the resulting copolymer, and the miscibility, flexibility, and thermal stability of the binder (e.g., gelatin) of the photographic colloid composition.

The polymer coupler used in this invention may be water-soluble or water-insoluble, and a polymer coupler latex is preferable.

The examples of the pyrazoloazole system magenta coupler represented by Formula (I) used in this invention are described, together with their production processes, in Japanese Patent Application Nos. 23434/1983, 151354/1983, 45512/1983, 27745/1984, and 142801/1983, and U.S. Pat. No. 3,061,432.

The following are examples of the typical magenta coupler and yinyl monomer thereof which are used in this invention. They should not be construed as limiting the scope of this invention.
Exemplified compounds:
M-1
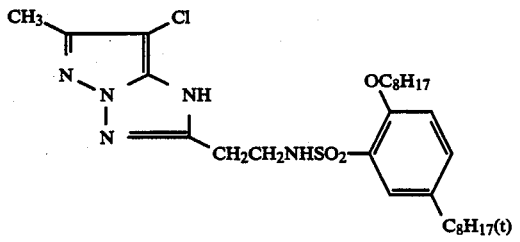
M-2
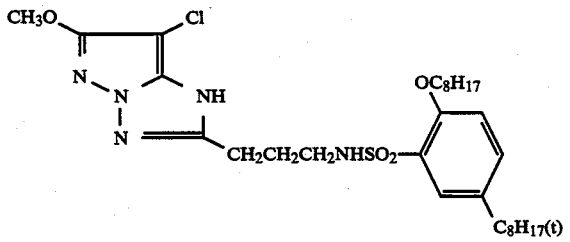
M-3
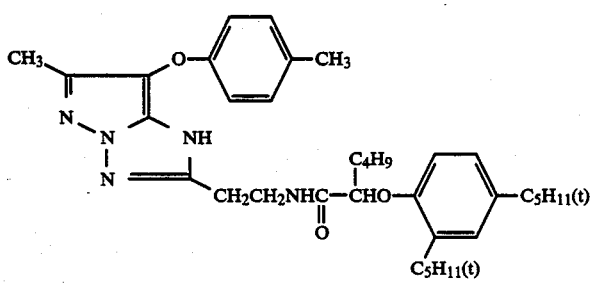
M-4
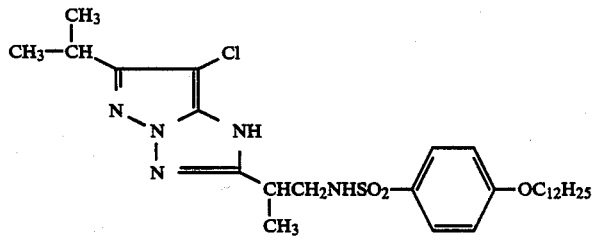
M-5
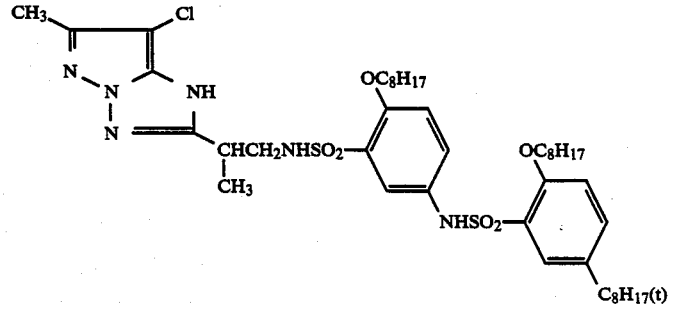

-continued
M-6
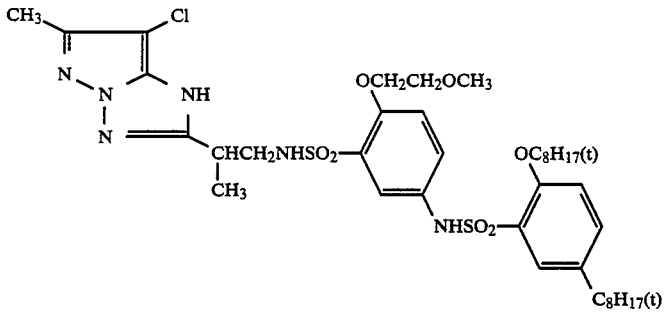
M-7
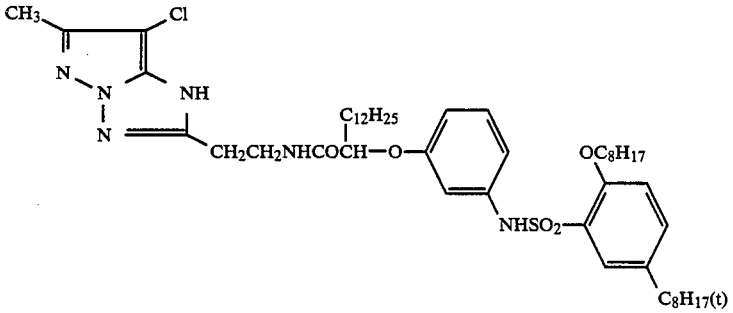
M-8
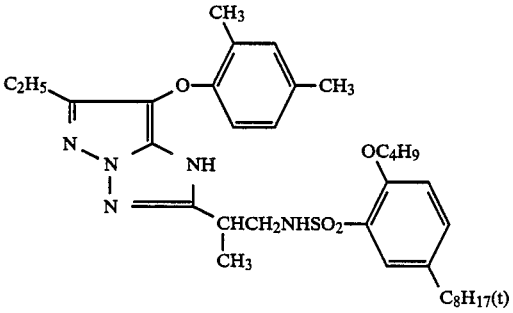
M-9
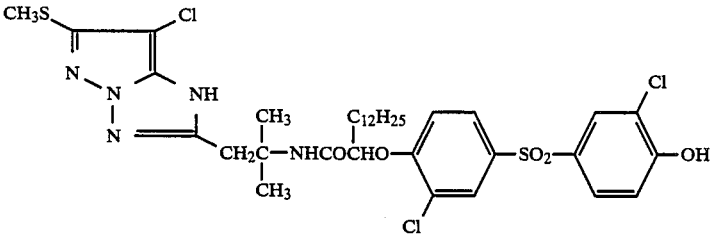
M-10
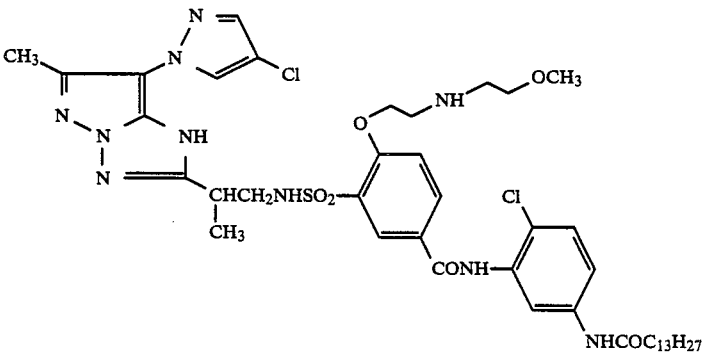

-continued
M-11
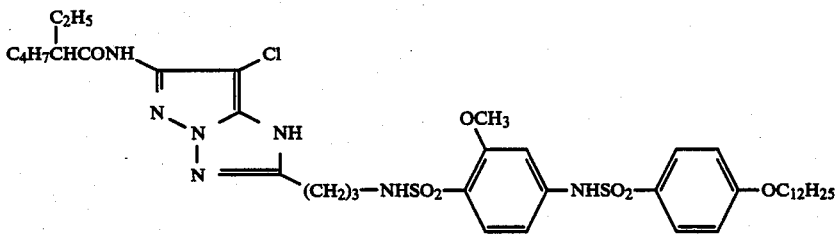
M-12
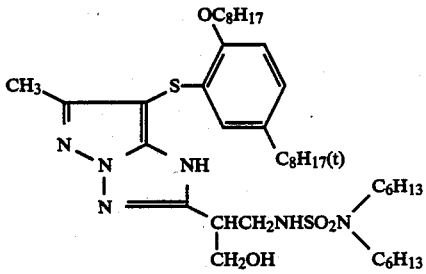
M-13
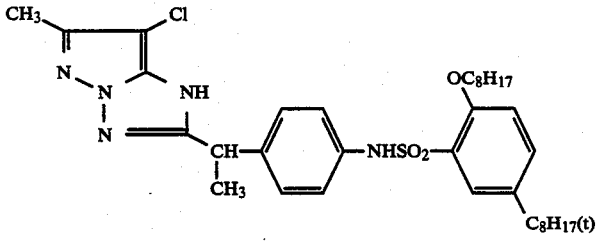
M-14
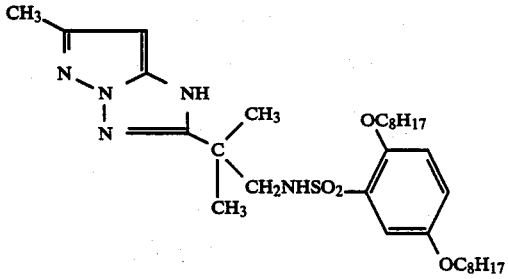
M-15
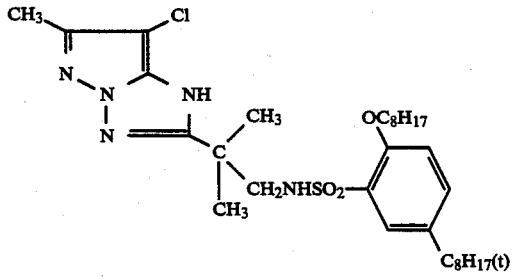
M-16
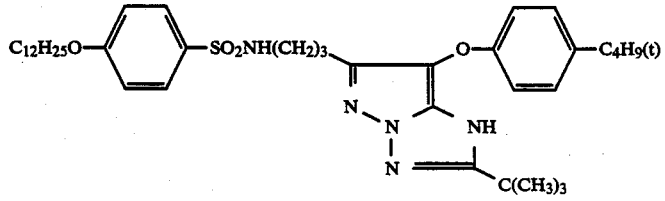

-continued
M-17
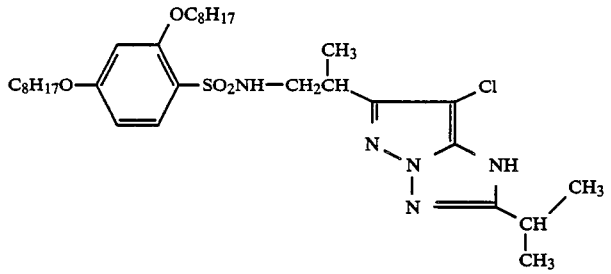
M-18
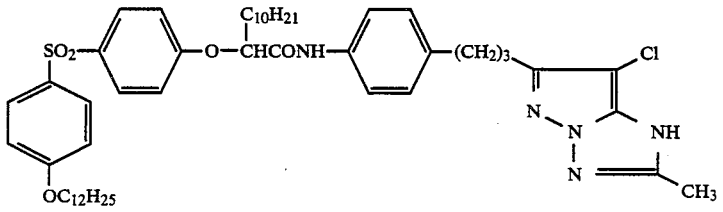
M-19
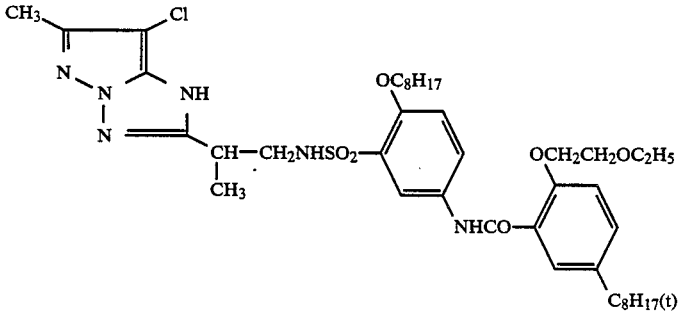
M-20
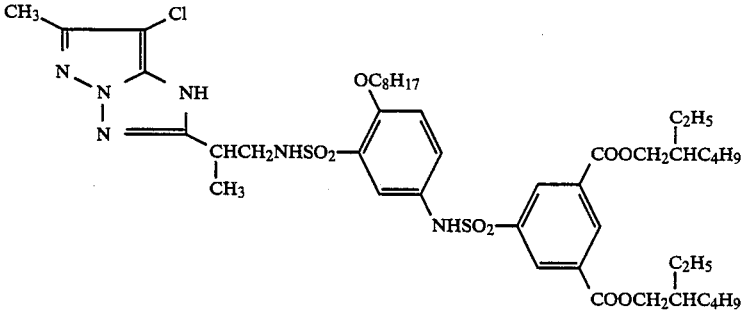
M-21
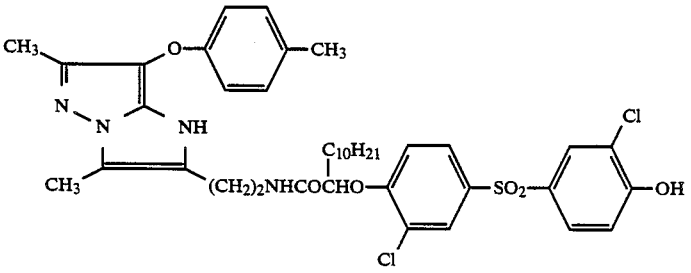

-continued
M-22
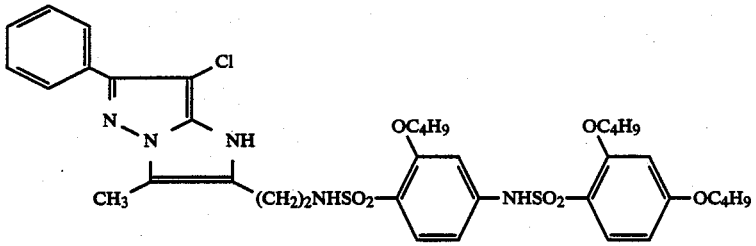
M-23
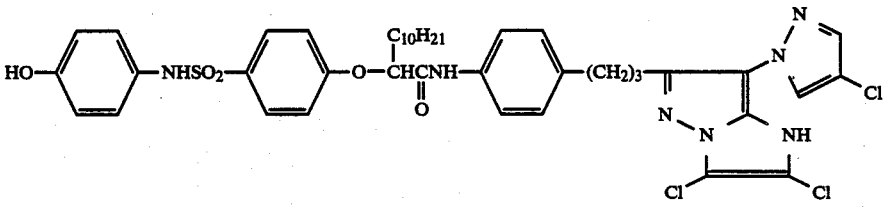
M-24
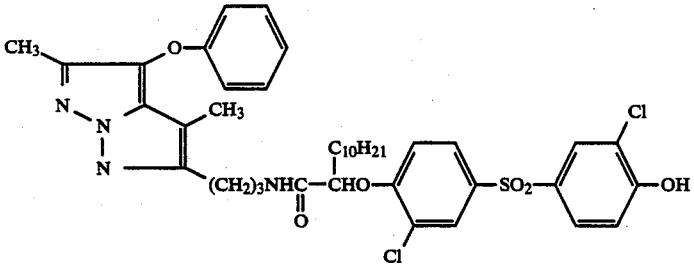
M-25
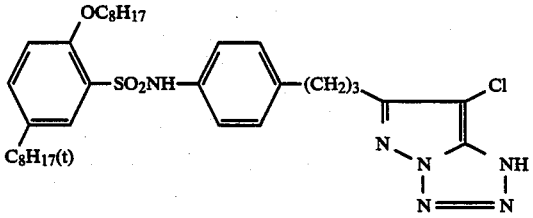
M-26
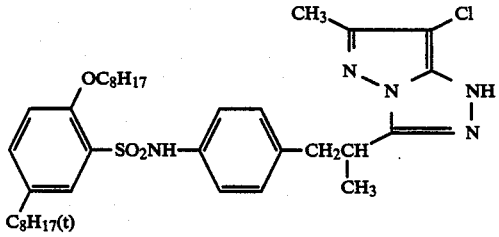
M-27
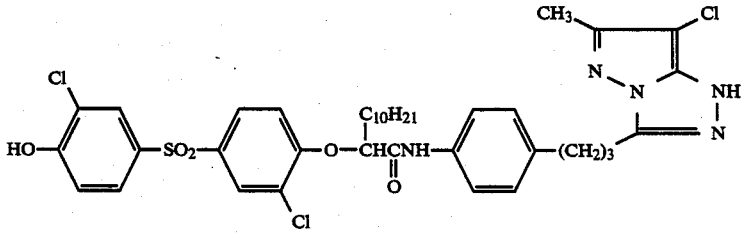

-continued
M-28
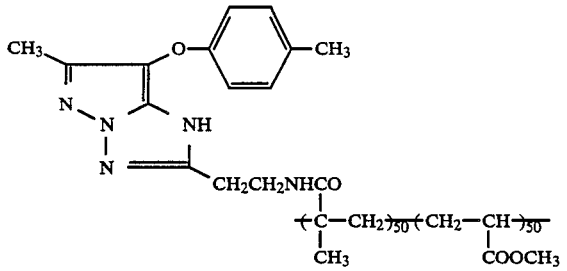
M-29
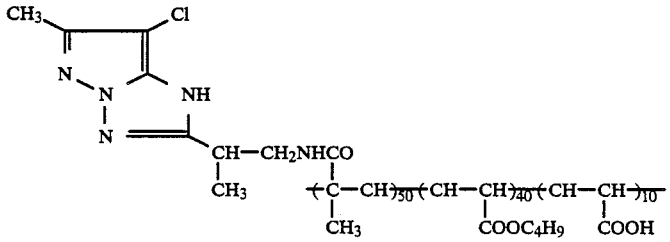
M-30
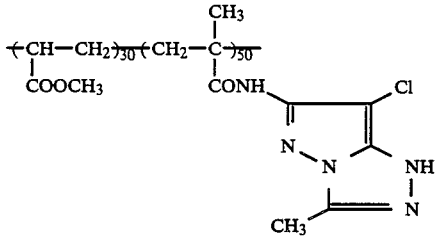
M-31
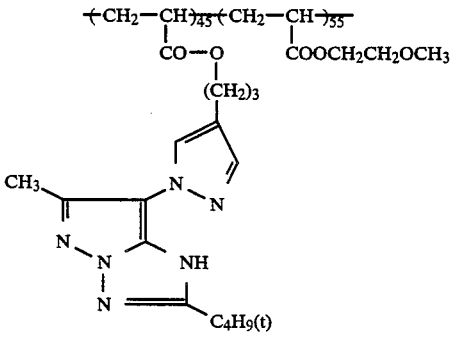
M-32
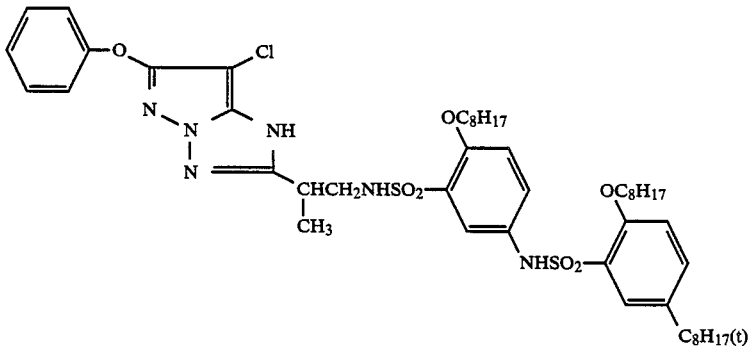
M-33
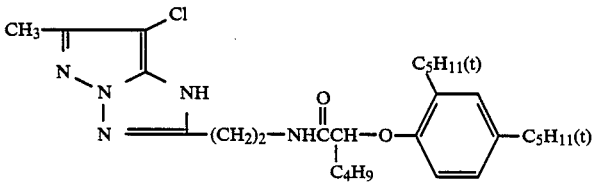

-continued
M-34
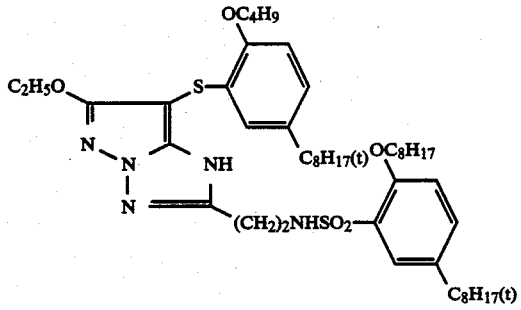
M-35
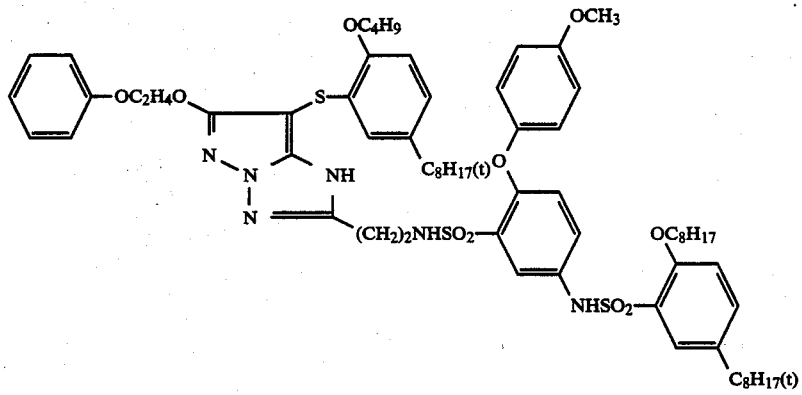
M-36
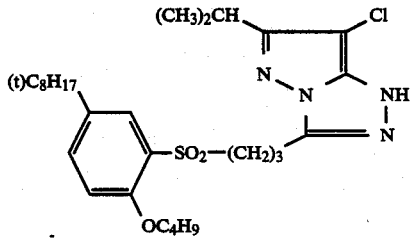
M-37
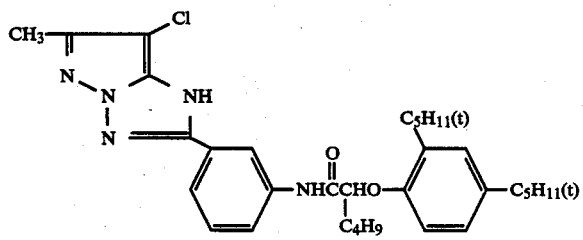
M-38
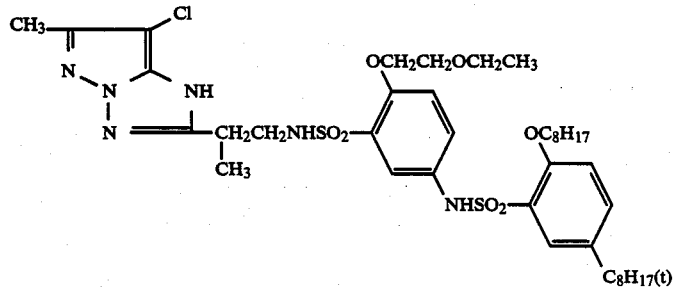

-continued

M-39

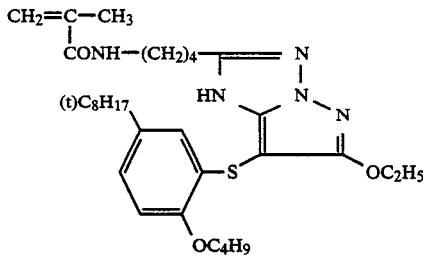

The coupler of this invention represented by Formula (I) is added to an emulsion layer in an amount of $1\times10^{-3}$ mol to 1 mol, preferably $5\times10^{-2}$ mol to $5\times10^{-1}$ mol, per mol of silver halide included in the same layer. More than one kind of the coupler of this invention may be added to the same emulsion layer.

The magenta coupler of this invention may be used in combination with a cyan coupler and yellow coupler. Typical examples are naphthol or phenol compounds and open-chained or heterocyclic ketomethylene compounds. Examples of these cyan couplers and yellow couplers are described in the patents cited in Research Disclosure (RD) 17643 (December 1978), Section VII-D, and 18717 (November 1979).

Color-forming couplers for incorporation in the present photographic materials are preferably nondiffusible by being ballasted or polymerized. Two-equivalent couplers having a coupling-off group at the coupling active position are more preferable than four-equivalent couplers having only hydrogen at the coupling position in view of reduced silver coverage. Couplers can be employed in the present invention which form a dye of controlled image smearing or a colorless compound as well as DIR couplers which release a development inhibiting reagent upon coupling reaction and couplers releasing a development accelerating agent.

Representative examples of yellow couplers useful in the present invention include couplers of the "oil-protected" (hydrophobically ballasted) acylacetoamide type, as illustrated in U.S. Pat. Nos. 2,407,210, 2,875,057, and 3,265,506. Typical examples of two-equivalent yellow couplers preferable in the present invention include yellow couplers having an oxygen-linked coupling-off group as illustrated in U.S. Pat. Nos. 3,408,194, 3,447,928, 3,933,501, and 4,022,620; yellow couplers having a nitrogen-linked coupling-off group as illustrated in Japanese Patent Publication No. 10739/1983, U.S. Pat. Nos. 4,401,752 and 4,326,024, *Research Disclosure* No. 18053 (April 1979), British Pat. No. 1,425,020 and German Pat. Nos. (OLS) 2,219,917, 2,261,361, and 2,433,812. Couplers of the α-pivaloylacetoanilide type are superior in fastness of formed dyed particularly on exposure to light, while couplers of the α-benzoylacetoanilide type are capable of forming high maximum density.

The cyan coupler that can be used in this invention includes naphthol couplers and phenol couplers of oil-protected type. An example of naphthol coupler is that disclosed in U.S. Pat. No. 2,474,293 and preferred examples of naphthol couplers are such two-equivalent naphthol couplers as oxygen atom splitting-off type disclosed in U.S. Pat. Nos. 4,052,212, 4,146,396, 4,228,233, and 4,296,200. Examples of the phenol couplers are those disclosed in U.S. Pat. Nos. 2,369,929, 2,801,171, 2,772,162, and 2,895,826.

Examples of cyan couplers stable to moisture and heat and advantageously used in this invention include phenol cyan couplers having a higher alkyl group than methyl group at meta position of the phenol nucleus disclosed in U.S. Pat. No. 3,772,002, 2,5-diacylamino-substituted phenol cyan couplers disclosed in U.S. Pat. Nos. 2,772,162, 3,758,308, 4,126,396, 4,334,011, 4,327,173, German Pat. No. (OLS) 3,329,729 and Japanese Patent Publication No. 42671/1983 and phenol cyan couplers having a phenylureido group at 2-position and an acylamino group at 5-position disclosed in U.S. Pat. Nos. 3,446,622, 4,333,999, 4,451,559, and 4,427,767.

In order to satisfy the characteristics desired to the photographic materials, various couplers used in the present invention can be employed as a combination of two or more couplers in a light-sensitive layer, or the same compound can be employed in two or more layers.

The couplers of the present invention can be incorporated to photographic materials by various known dispersion techniques. Typically, the couplers may be added according to solid dispersing process, the alkaline dispersing process, preferably, to the latex dispersing process, more preferably, to the oil-in-water dispersing process employing the organic solvent of the present invention. According to the oil-in-water dispersing process, dispersants are first dissolved in a single or mixed solvent of a high-boiling (having a boiling point of 170° C. or higher) organic solvent or a low-boiling (auxiliary) organic solvent, and then dispersed as fine particles in an aqueous medium, e.g., water or an aqueous gelatine solution in the presence of surface active agents. Examples of the high-boiling organic solvents are described in U.S. Pat. No. 2,322,027.

The aforementioned color couplers in the present invention is incorporated in a light-sensitive silver halide emulsion layer, usually in an amount of about 0.001 to 1 mol per mol of silver halide, preferably, in an amount of about 0.001 to 0.5 mol with respect to yellow couplers and in an amount of about 0.002 to 0.3 mol with respect to cyan couplers.

Silver halide emulsions for use in the present invention can be prepared generally by mixing an aqueous solution of silver salts (e.g., silver nitrate) and an aqueous solution of halides (e.g., potassium bromide, sodium chloride, potassium iodide, alone or in combination thereof) in the presence of water-soluble polymers (e.g., gelatine).

Silver halide grains may have internal and external portions different in composition, may have a multiphase structure joined by epitaxial junction, may have a uniform structure, or may comprise a mixture of grains of various crystal forms. With respect to silver chlorobromide having different internal phases, the grains may have nuclei or one or more internal structure having higher silver bromide content or silver chloride content than the average halogen content.

The average size of the silver halide grains can be expressed in terms of the grain diameter for spherical or semi-spherical grains and in terms of the edge length for cubic grains, can be determined as the average of the projected area diameter etc., and is preferably smaller than 2 microns and larger than 0.1 microns, and particularly preferably smaller than 1 micron and larger than 0.15 microns.

The distribution of grain size may be either narrow or wide. A monodisperse emulsion of silver halide may be employed in the present invention. The monodisperse emulsion may have a fluctuation coefficient, as a monodisperse index, of 15% or less preferably and 10% or less more preferably, which coefficient is obtained by dividing standard deviation calculated from the curve of size distribution by an average particle size. In order to realize the gradation desired for the photographic material, two or more monodisperse silver halide emulsions different in grain size may be mixed in a single layer, or coated as different layers having essentially the same color sensitivity. Further, two or more polydisperse silver halide emulsions or combination of monodisperse and polydisperse emulsions can be employed as mixture in one layer or coated as different layers.

Silver halide grains in the photographic emulsion may have a regular crystal structure such as a cubic, hexahedral, dodecahedral or tetradecahedral structure, an irregular crystal structure such as a spherical structure or a composite crystal structure thereof. Tabular grains may be employed wherein at least 50 percent of the total projected area of silver halide grains is tabular grains having a diameter-to-thickness ratio of about 5 or more, particularly of about 8 or more. Silver halide emulsions may be a mixture of various crystal structures. Silver halide grains may be used which form a latent image primary on the grain surface or those may be used which form a latent image primary in the interior of the grains.

The photographic emulsion for use in the present invention can be prepared by the processes described in P. Glafkides, *Chimie et Physique Photographique*, Paul Montel (1967), G. F. Duffin, *Photographic Emulsion Chemistry*, The Focal Press (1966), V. L. Zelikman et al., *Making and Coating Photographic Emulsions*, The Focal Press (1964), etc. Any one of the acidic process, a neutral process, and an ammoniacal process can be used. As a manner of reacting a soluble silver salt with a soluble halide salt, any of the single jet method, double jet method and a combination thereof may be employed.

A process of forming grains in the presence of excess silver ion (the so-called reversal mixing process) can be employed as well. A conversion method of adding such a silver salt as to form a more insoluble silver halide may also be employed. As one type of the double jet method, the "controlled double jet" process can be employed wherein the pAg in the liquid phase of silver halide formation is kept constant. This process provides a silver halide emulsion containing regular silver halide grains having an approximately monodisperse particle size.

During formation or physical ripening of the silver halide grains, cadmium salts, zinc salts, lead salts, thallium salts, iridium salts or the complex salts thereof, rhodium salts or the complex salts thereof, iron salts or the complex salts thereof, etc., may also be present. After physical ripening, silver halide emulsions are usually subjected to desalting and chemical sensitization for use in coating. Precipitation, physical ripening and chemical ripening can be carried out in the presence of conventional silver halide solvents (e.g., ammonia, potassium thiocyanate, thioethers and thiones described in U.S. Pat. No. 3,271,157, Japanese Patent Application (OPI) Nos. 12360/1976, 82408/1978, 144319/1978, 100717/1979 and 155828/1979. Removing soluble salts from emulsions after physical ripening can be achieved by noodle washing, flocculation precipitation or ultrafiltration, etc.

Photographic emulsions in the present invention can be spectrally sensitized with photographic sensitizing dyes such as methine dyes.

To the photographic emulsion for use in the present invention, various compounds can be incorporated for the purpose of stabilizing photographic properties and of preventing fog formation during the steps of producing, storing or processing of, photographic materials. Examples of such antifoggants or color-mixing preventing agent include hydroquinones, aminophenols, amines, gallic acid derivatives, catechols, ascorbic acid derivatives, non-color forming coupler, sulfonamidophenols. Further various discoloration agents may be employed in the photographic material of the present invention.

The photographic material of the present invention may contain in its hydrophilic colloidal layer an ultraviolet light absorbent.

The photographic material of the present invention may contain one or more surfactants for the purpose of coating aids, antistatic agents, slipping aids, emulsifying or dispersing aids, adhesion prevention, photographic characteristics improvement (e.g., development acceleration, high gradation, sensitivity increase), etc.

To the photographic material of the present invention, in addition to the above described additives, may be added various photographic additives such as stabilizers, stain preventing agents, developers or precursors thereof, lubricating agents, mordants, antistatic agents, plasticizers, examples of which are described in *Research Disclosure*, Nos. 17643 (December, 1978) and 18716 (November, 1979).

The present invention may also be applied to a multilayered, multicolor photographic material comprising a support having thereon at least two layers with different spectral sensitivities. Multilayered natural color photographic materials usually comprise a support having thereon at least one red-sensitive emulsion layer, and at least one blue-sensitive emulsion layer. The order of these layers may be optionally selected as the case demands.

Each emulsion layer of these arrangements may be composed of two or more sublayers of different sensitivities and a non-sensitive layer may be present between two or more layers of the same spectral sensitivity.

The photographic material according to the present invention may have auxiliary layers such as protective layers, intermediate layers, filter layers, antihalation layers, backing layers, etc., if necessary, in addition to silver halide emulsion layers.

The photographic emulsion layer of the present invention forming the dye image is coated on a flexible base or support such as a synthetic resin film, paper or cloth usually used for photographic materials, or on a rigid base or support such as glass, earthenware, metal, etc. Examples of useful base or support include a barayta paper or a polyethylene-laminated paper with white pigment such as titanium oxide mixed in the polyethylene.

The present invention may be applied to variety of photographic materials. Typical examples of the silver halide color photographic materials of the present invention include a general color negative film or a movie color negative film, a color reversal film for a slide or a television, a color printing paper, a colorpositive film and a color reversal printing paper. The present invention may also be applied to such a black and white photographic material utilizing mixing of three color-forming couplers as disclosed in *Research Disclosure* No. 17123 (July 1978).

Color developers for development-treating the photographic materials of the present invention generally comprise an alkaline aqueous solution containing an aromatic primary amine developing agent. Suitable color developing agents include known aminophenols and preferably p-phenylenediamines (e.g., 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and their salts between sulfuric acid, hydrochloric acid or p-toluenesulfonic acid, etc.).

The color developer may further contain pH buffers such as alkali metal carbonates, borates or phosphates, development inhibitors or antifogging agents such as bromides, iodides, and organic antifogging agents (e.g., benzimidazoles, benzothiazoles, mercapto compounds).

Color developed photographic emulsion layers are usually bleached. Bleaching may be conducted separately or simultaneously with fixing. Compounds of polyvalent metals such as iron (III), cobalt (III), chromium (III), copper (II), etc., peracids, quinones, nitroso compounds, etc., can be used as bleaching agents. Typical examples of useful bleaching agents include ferricyanates, dichromates, organic complex salts of iron (III) or cobalt (III) such as complex salts with an aminopolycarboxylic acid (e.g., ethylenediaminetetraacetic acid, diethylenetriaminepentaacetic acid, nitrilotriacetic acid, 1,3-diamino-2-propanoltetraacetic acid, etc.) or an organic acid (e.g., citric acid, tartaric acid, maleic acid, etc.); persulfates, permanganates; nitrosophenol; etc., may be used. Of these, potassium ferricyanate, iron (III) sodium ethylenediaminetetraacetate, and iron (III) ammonium ethylenediaminetetraacetate are particularly useful from the view points of rapid treatment and less environmental pollution. Iron (III) ethylenediaminetetraacetates are useful in both an independent bleaching solution and a monobath bleach-fixing solution.

In a bleaching solution or a bleach-fixing solution, various accelerators can be used if necessary. Water for washing may be incorporated with a variety of known compounds for the prevention of precipitation and the saving of water. For example, a water softener such as inorganic phosphoric acid, aminopolycarboxylic acid, and organic phosphoric acid may be added for the prevention of precipitation; and an antiseptic may be added for the inhibition of bacteria, algae, and molds. Other additives that may be added as required include a hardening agent such as magnesium salt and aluminum salt and a surface active agent that makes for uniform drying. A compound as disclosed in Phot. Sci. Eng., Vol. 6 (1965), p. 344–359, Water Quality Criteria, by L. E. West may be used as an additive. The addition of a chelating agent and antiseptic agent is particularly effective.

The washing is usually performed in the countercurrent manner using two or more vessels for the saving of water. The washing step may be replaced by the multistage countercurrent stabilizing step as disclosed in Japanese Patent Application (OPI) No. 8543/1982. This step requires 2 to 9 countercurrent baths incorporated with a variety of compounds for the stabilization of photographic images. Examples of the additives are formalin and buffers to adjust the pH of the gelatin emulsion. (The buffers are prepared by combining boric acid, metaboric acid, borax, phosphate, carbonate, potassium hydroxide, ammonia water, monocarboxylic acid, dicarboxylic acid, polycarboxylic acid, etc. with one another.) Other additives are water softener (e.g., inorganic phosphoric acid, aminopolycarboxylic acid, organic phosphoric acid, aminopolysulfonic acid, and phosphonocarboxylic acid), antiseptic agent (e.g., benzoisothiazolinone, isothiazolone, 4-thiazolinebenzimidazole, and halogenated phenol), surface active agent, fluorescent brightener, and hardening agent. Two or more additives for the same object may be used together.

In order to adjust the pH of the emulsion after processing, it is preferable to add an ammonium salt such as ammonium chloride, ammonium nitrate, ammonium sulfate, ammonium phosphate, ammonium sulfite, and ammonium thiosulfate.

The silver halide color photosensitive material of this invention may be incorporated with precursors of color developing agents so as to simplify and speed up the processing.

The silver halide color photographic material of the present invention may contain various 1-phenyl-3-pyrazolidones, if necessary, in order to accelerate the color development. Typical examples thereof are described in Japanese Patent Application (OPI) Nos. 64339/1981, 144547/1982, 211147/1982, 50532/1983, 50536/1983, 50533/1983, 50534/1983, 50535/1983, and 115438/1983.

Various development processing baths useful for the present invention are used at a temperature range of 10° C. to 50° C. The temperature range of 33° C. to 38° C. is generally employed; higher temperatures enable accelerated processing of shortened processing time; lower temperatures can be employed in view of improved picture quality and improved stabilities of the processing liquids. Image enhancement processing by means of cobalt compounds or hydrogen peroxide described in German Pat. No. 2,26,700 or U.S. Pat. No. 3,674,499 can be employed to process the photographic materials having less silver halides.

Various types of processing baths useful for the present invention may be equipped with heaters, temperature sensors, liquid surface sensors, circulating pumps, filters, floating covers, squeegees, etc.

The silver halide color photographic material of the present invention forms a color image with improved color reproducibility and improved image stability. The improvement in color reproducibility is attributable to the magenta coupler which forms a bright dye having less subsidiary absorption as compared with the dye formed from 5-pyrazolone magenta coupler, as described in U.S. Pat. Nos. 4,500,630 and 4,540,654.

The silver halide color photographic material is less liable to magenta fogging during development. Further the color photographic material provides a image less dependent on processing conditions. Still further the color photographic material provides a color image with white background improved in yellowing.

The present invention will now be illustrated in greater detail with reference to the following examples, but it should be understood that these examples are not limiting the present invention.

EXAMPLES

(1) Preparation of silver halide emulsion

An aqueous solution containing potassium bromide and sodium chloride in a molar ratio of 7:3 and an aqueous solution of silver nitrate were added with vigorous agitation to an aqueous solution of gelatin containing sodium chloride at 60° C. by double-jet method. After the completion of physical ripening, the soluble salts were removed by precipitation method. Additional gelatin was added for redispersion. $2.0\times10^{-5}$ mol of sodium thiosulfate and 400 mg of ribonucleic acid ("RNA-F", a product of Sanyo Kokusaku Pulp Co., Ltd.) were added per mol of silver halide, and chemical sensitization was performed at 55° C. Thus there was obtained emulsion A of silver chlorobromide containing 70 mol % of silver bromide.

Emulsion B was prepared in the same manner as above, except that 180 mg of adenine was added in place of ribonucleic acid at the time of chemical sensitization.

For comparison, emulsion C was prepared in the same manner as described in emulsion A above, except that ribonucleic acid was not added at the time of chemical sensitization.

(2) Preparation of sample of color photographic material

Multilayer color photographic paper was prepared by applying the coating solutions to a polyethylene-laminated (both sides) paper base. The constitution of the layers is shown in Table 1. The coating solutions were prepared as follows:

Coating solution for the first layer:

10 g of yellow coupler (a) and 2.1 g of dye stabilizer were dissolved in 10 ml of ethyl acetate and 1.4 ml of solvent (c). The resulting solution was emulsified and dispersed into 90 ml of 10% gelatin solution containing 10 ml of 1% sodium dodecylbenzenesulfonate solution. On the other hand, 95 g of blue-sensitive emulsion was prepared by adding to a silver chlorobromide emulsion (silver bromide: 85 mol %, and Ag 70 g/kg) $2.25\times10^{-4}$ mol of blue-sensitive dye shown below per mol of silver chlorobromide. The emulsified dispersion and the emulsion were mixed with each other, and gelatin was added to the mixture to adjust the concentration so that the composition shown in Table 1 was obtained.

The coating solutions for the second to seventh layers shown in Table 1 were prepared in the same manner as above. The gelatin hardener for each layer was sodium salt of 1-oxy-3,5-dichloro-s-triazine.

The following spectral sensitizers were used for the respective emulsions.

Spectral sensitizer for blue-sensitive emulsion layer:

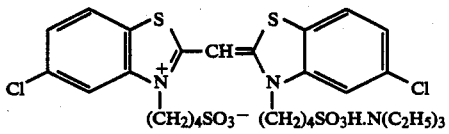

($5.0\times10^{-4}$ mol per mol of silver halide)

Spectral sensitizer for green-sensitive emulsion layer:

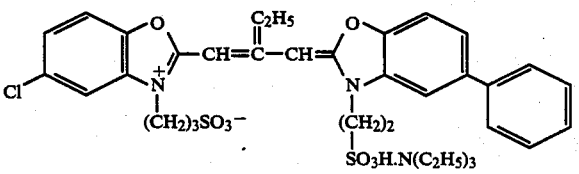

($4.0\times10^{-4}$ mol per mol of silver halide)

and

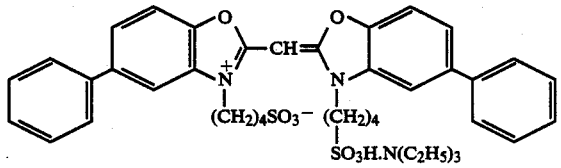

($7.0\times10^{-5}$ mol per mol of silver halide)

Spectral sensitizer for red-sensitive emulsion layer:

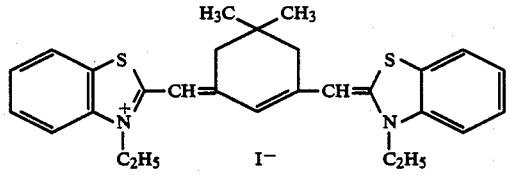

($0.9\times10^{-4}$ mol per mol of silver halide)

To the red-sensitive emulsion layer, the following compound was added in the amount of $2.6\times10^{-3}$ mol per mol of silver halide.

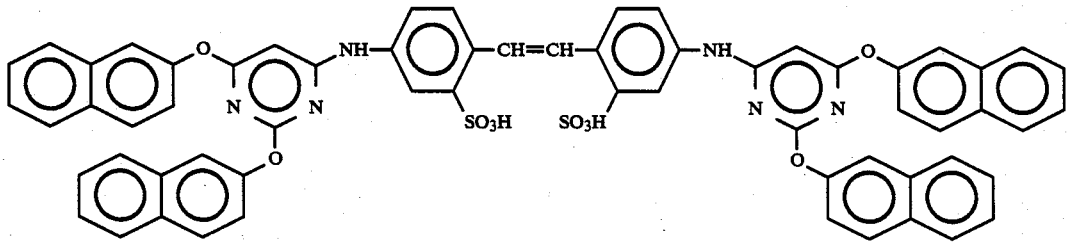

Further, to the blue-sensitive emulsion layer, green-sensitive emulsion layer and red-sensitive emulsion layer, 1-(5-methylureidophenyl)-5-mercaptoterazole was added in the amount of $8.5\times10^{-5}$ mol, $7.7\times10^{-4}$ mol and $2.5\times10^{-4}$ mol per mol of silver halide, respectively. To the blue-sensitive emulsion layer and green-sensitive emulsion layer, 4-hydroxy-6-methyl-1,3,3a,7-tetrazaindene was added in the amount of $1.2\times10^{-2}$ mol and $1.1\times10^{-2}$ mol per mol of silver halide, respectively.

The following dyes were used for the prevention of irradiation in respective emulsion layers.

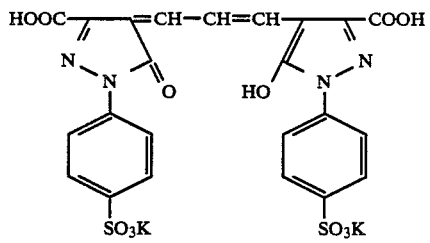

and

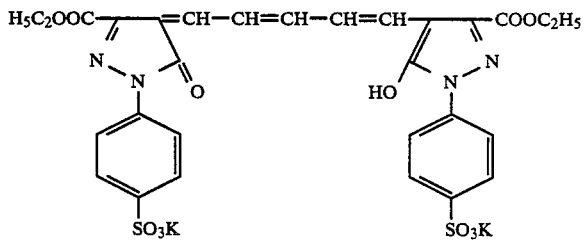

The following are the structural formulas of the couplers and other compounds used in this Example.

(a) Yellow coupler

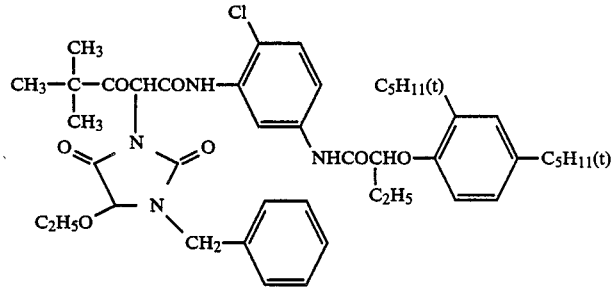

(b) Dye stabilizer

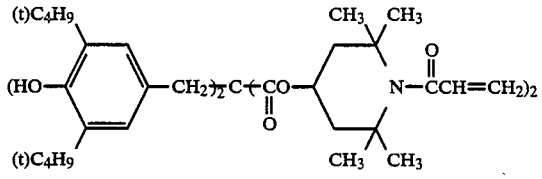

(c)Solvent $(C_9H_{19}O)_3P{=}O$ (d) Color-mixing preventing agent

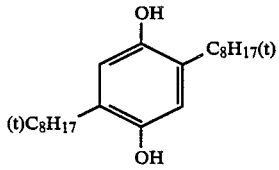

(e) Solvent: 1:1 mixture (by volume) of

-continued

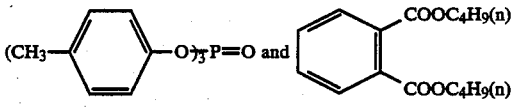

(f) UV light absorbent: 1:5:3 mixture (by mol) of

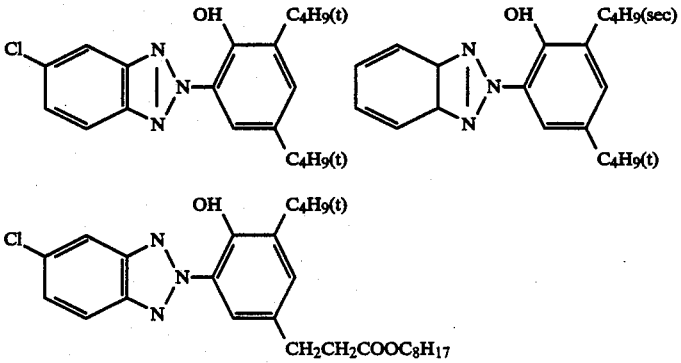

(g) Cyan coupler: 1:1 mixture (by mol) of

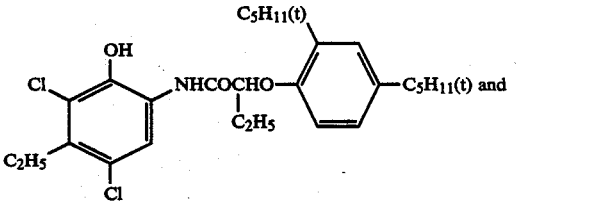

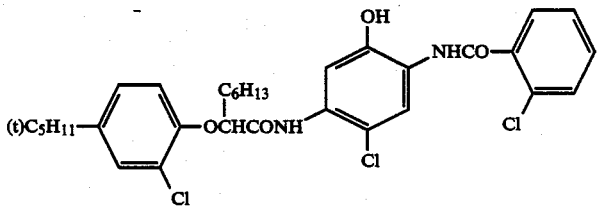

(h) Dye stabilizer: 1:3:3 mixture (by mol) of

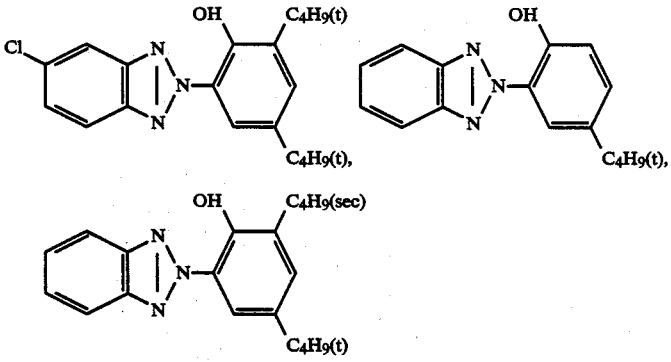

(i) Solvent: 1:2 mixture (by volume) of

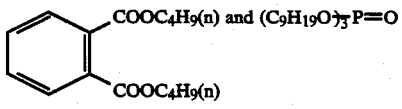

The coating solutions for the first to seventh layers were adjusted to a balanced surface tension and viscosity, and the solutions were applied simultaneously to form a multilayer silver halide photographic material.

Thus, Samples 101 to 109 were prepared in which the third layer alone was changed as shown in Table 2.

TABLE 1

| Layer | Constituents | Amount |
|---|---|---|
| 7th layer (Protective layer) | Gelatin | 1.33 g/m$^2$ |
| 6th layer | Gelatin | 0.62 g/m$^2$ |
| (UV light absorbing layer) | UV light absorbing agent (f) | $5.10 \times 10^{-4}$ mol/m$^2$ |
| | Solvent (c) | 0.07 g/m$^2$ |
| 5th layer | Silver chlorobromide emulsion (AgBr 50 mol %) Ag: | 0.22 g/m$^2$ |
| (Red-sensitive layer) | Gelatin | 0.93 g/m$^2$ |
| | Cyan coupler (g) | $7.05 \times 10^{-4}$ mol/m$^2$ |
| | Dye stabilizer (h) | $5.20 \times 10^{-4}$ mol/m$^2$ |
| | Solvent (i) | 0.25 g/m$^2$ |
| 4th layer | Gelatin | 1.43 g/m$^2$ |
| (UV light absorbing layer) | UV light absorber (f) | $1.50 \times 10^{-3}$ mol/m$^2$ |
| | Color-mixing preventing agent (d) | $1.50 \times 10^{-4}$ mol/m$^2$ |
| | Solvent (c) | 0.22 g/m$^2$ |
| 3rd layer | Silver chlorobromide emulsion (AgBr 70 mol %) | |
| (Green-sensitive layer) | Gelatin | |
| | Magenta coupler | as shown in |
| | Dye stabilizer | Table 2. |
| | Solvent | |
| 2nd layer | Gelatin | 0.92 g/m$^2$ |
| (Color mixture preventive layer) | Color-mixing preventing agent (d) | $2.33 \times 10^{-4}$ mol/m$^2$ |
| | Solvent (e) | 0.15 g/m$^2$ |
| 1st layer | Silver chlorobromide (AgBr 85 mol %) Ag: | 0.38 g/m$^2$ |
| (Blue-sensitive layer) | Gelatin | 1.41 g/m$^2$ |
| | Yellow coupler (a) | $7.22 \times 10^{-4}$ mol/m$^2$ |
| | Dye stabilizer (b) | $1.35 \times 10^{-4}$ mol/m$^2$ |
| | Solvent (c) | 0.08 g/m$^2$ |
| Base | Polyethylene-laminated paper (polyethylene in contact with the 1st layer contains a white pigment ($TiO_2$) and a bluing material (Ultramarine blue). | |

TABLE 2

| 3rd layer | Sample No. | | | | | | | | |
|---|---|---|---|---|---|---|---|---|---|
| (green-sensitive layer) | 101 | 102 | 103 | 104 | 105 | 106 | 107 | 108 | 109 |
| Emulsion used | A | B | C | A | B | C | A | B | C |
| Silver (g/m$^2$) | 0.22 | 0.22 | 0.22 | 0.24 | 0.24 | 0.24 | 0.45 | 0.45 | 0.45 |
| Gelatin (g/m$^2$) | 1.30 | 1.30 | 1.30 | 1.30 | 1.30 | 1.30 | 1.30 | 1.30 | 1.30 |
| Coupler used* | M-38 | M-38 | M-38 | M-35 | M-35 | M-35 | (l) | (l) | (l) |
| Amount of coupler (mol/m$^2$) | $4.20 \times 10^{-4}$ | "*** | " | " | " | " | " | " | " |
| Dye stabilizer (j) (mol/m$^2$) | $2.10 \times 10^{-4}$ | " | " | " | " | " | " | " | " |
| Solvent (k) (g/m$^2$) | 0.25 | " | " | " | " | " | " | " | " |
| Remarks** | (P) | (P) | (C) | (P) | (P) | (C) | (C) | (C) | (C) |

*Exemplified compound of the magenta coupler represented by Formula (I).
**(P): Present invention (C): Comparative Example
***Symbol (") means "same as the value on the left".
(j) Dye stabilizer

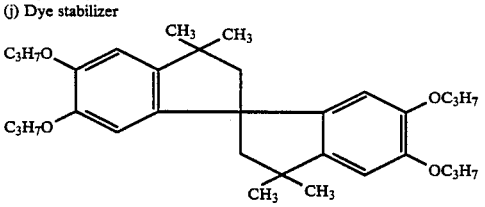

(k) Solvent
$(C_8H_{17}O\overline{)_3}P{=}O$
(l) Magenta coupler

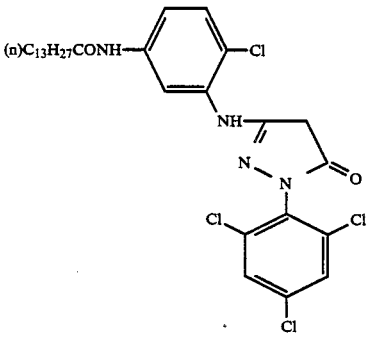

(3) Exposure and development of color photographic material

Each sample prepared according to the above-mentioned item (2) was subjected to gradation exposure for sensitometry through a green filter using an enlarging apparatus (Fuji color head 609 (Tradename) made by Fuji Photo Film Co., Ltd.). Development was carried out by the following processing steps (1) and (2).

| Processing step (1) | Temperature | Time |
|---|---|---|
| Developing solution | 33° C. | 3.5 min |
| Bleach-fix solution | 33° C. | 1.5 min |
| Washing | 24–35° C. | 3.0 min |

| | |
|---|---|
| Developing solution | |
| Diethylenetriamine pentaacetate | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfuric acid salt | 3.0 g |
| 4-amino-3-methyl-N—ethyl-N—[β-(methanesulfonamido)ethyl]-p-phenylenediamine sulfuric acid salt | 5.0 g |
| $Na_2CO_3$ (monohydrate) | 30.0 g |
| Water to make | 1000 ml |
| pH | 10.1 |
| Bleach-fix solution | |
| Ammonium thiosulfate (54 wt %) | 150 ml. |
| $Na_2SO_3$ | 15.0 g |
| $NH_4$[Fe(EDTA)] | 55.0 g |
| EDTA.2Na | 4.0 g |
| Water to make | 1000 ml |
| pH | 6.9 |

| Processing step (2) | Temperature | Time |
|---|---|---|
| Developing solution | 38° C. | 3.5 min |
| Bleach-fix solution | 33° C. | 1.5 min |
| Washing | 24–35° C. | 3.0 min |

| | |
|---|---|
| Developing solution | |
| Diethylenetriamine pentaacetate | 4.0 g |
| Benzyl alcohol | 15 ml |
| Diethylene glycol | 10 ml |
| $Na_2SO_3$ | 2.0 g |
| KBr | 1.0 g |
| $Na_2CO_3$ (monohydrate) | 30.0 g |
| N—ethyl-N—(β-methanesulfonamidoethyl)-3-methyl-4-aminoaniline sulfuric acid salt | 5.0 g |
| Hydroxylamine sulfuric acid salt | 4.0 g |
| Brightening agent (stilbene type) | 1.0 g |
| Water to make | 1000 ml |
| pH | 10.1 |
| Bleach-fix solution | |
| Ammonium thiosulfate (54 wt %) | 150 ml |
| $Na_2SO_3$ | 18.0 g |
| $NH_4$[Fe(EDTA)] | 55.0 g |
| EDTA.2Na | 5.0 g |
| Water to make | 1000 ml |
| pH | 6.7 |

In order to evaluate the liability to magenta fogging, the processing steps (1) and (2) were carried out with the development time extended from the standard 3.5 minutes to 5.5 minutes.

The value of magenta fogging in this case was recorded as "forced fogging". The results obtained with Samples 101 to 109 are shown in Table 3.

TABLE 3

| | Processing step (1) | | Processing step (2) | | |
|---|---|---|---|---|---|
| Sample No. | Fogging (3.5 min) | Forced fogging (5.5 min) | Fogging (3.5 min) | Forced fogging (5.5 min) | Remarks* |
| 101 | 0.01 | 0.01 | 0.01 | 0.02 | P |
| 102 | 0.01 | 0.01 | 0.01 | 0.02 | P |

TABLE 3-continued

| | Processing step (1) | | Processing step (2) | | |
|---|---|---|---|---|---|
| Sample No. | Fogging (3.5 min) | Forced fogging (5.5 min) | Fogging (3.5 min) | Forced fogging (5.5 min) | Remarks* |
| 103 | 0.03 | 0.06 | 0.05 | 0.10 | C |
| 104 | 0.01 | 0.01 | 0.01 | 0.02 | P |
| 105 | 0.01 | 0.01 | 0.01 | 0.02 | P |
| 106 | 0.03 | 0.06 | 0.06 | 0.10 | C |
| 107 | 0.03 | 0.05 | 0.05 | 0.08 | C |
| 108 | 0.03 | 0.05 | 0.05 | 0.07 | C |
| 109 | 0.05 | 0.07 | 0.08 | 0.12 | C |

*P: Present invention,
C: Comparative Example

It is noted from Table 3 that the remarkable reduction in magenta fogging was realized only in the case where the emulsion contains the specific magenta coupler of this invention and a nucleic acid or a decomposition product thereof.

The samples 101 to 109 prepared in the above-mentioned procedure (2) which were not exposed were processed in the same manner as the above-mentioned processing step (2). The processed samples were stored under the following three different conditions respectively and the yellowing of the white background was observed.

(1) For 10 days at normal temperature (about 30° C.) in a xenon (200,000 lux) fade meter.
(2) For 7 days at 100° C.
(3) For 20 days at 80° C. and 70% RH Table 4 shows the amount of increase in yellow density of the white background which occurred in each sample. It is apparent from the results in Table 4 that the magenta coupler of this invention used in combination with a nucleic acid or a decomposition product thereof greatly suppresses the yellowing of the white background compared with the conventional magenta coupler, when the photographic materials are stored under various conditions.

Further samples of color photographic material were prepared in the same manner as described above, except that as a magenta coupler M-32, M-33, M-34, M-36, M-37 or M-39 was used in place of M-35 or M-38. According to the tests, those samples exhibited the same eminent photographic properties as the above.

TABLE 4

| Sample No. | Xenon | 100° C. | 80° C.-70% RH | Remarks |
|---|---|---|---|---|
| 101 | 0.02 | 0.04 | 0.07 | Magenta coupler of Formula (I) in this invention. |
| 102 | 0.02 | 0.04 | 0.07 | |
| 103 | 0.03 | 0.04 | 0.08 | |
| 104 | 0.03 | 0.04 | 0.07 | |
| 105 | 0.03 | 0.04 | 0.07 | |
| 106 | 0.03 | 0.04 | 0.07 | |
| 107 | 0.18 | 0.23 | 0.24 | Conventional magenta coupler of pyrazolone type |
| 108 | 0.19 | 0.24 | 0.24 | |
| 109 | 0.18 | 0.24 | 0.24 | |

As many apparently widely different embodiments of this invention may be made without departing from the spirit and scope thereof, it is to be understood that the invention is not limited to the specific embodiments thereof except as defined in the appended claims.

What is claimed is:

1. A silver halide color photographic material comprising a support and at least one silver halide emulsion layer disposed on said support, wherein said emulsion layer contains at least one type of magenta coupler from a pyrazoloazole system represented by Formula (V) or (VI) below, and said silver halide emulsion is a silver chlorobromide emulsion or a silver chloroiodobromide emulsion which is chemically sensitized in the presence of at least one compound selected from the group consisting of deoxyribonucleic acid, ribonucleic acid, adenine, guanine, uracil, cytosine and thymine prior to the completion of chemical sensitization by sulfur compounds:

Formula(V):

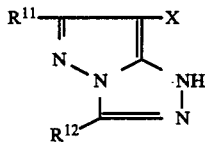

Formula(VI):

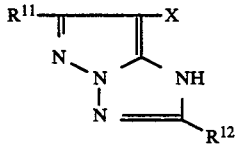

wherein $R^{11}$ and $R^{12}$, which may be the same or different from each other, independently represent a hydrogen atom, halogen atom, alkyl group, aryl group, heterocyclic group, cyano group, alkoxyl group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycarbonylamino group, aryloxycarbonylamino group, sulfonamido group, carbamoyl group, acyl group, sulfamoyl group, sulfonyl group, sulfinyl group, alkoxycarbonyl group, and aryloxycarbonyl group; and X represents a hydrogen atom, halogen atom, carboxyl group, or a coupling split-off group connected through an oxygen atom, nitrogen atom, or sulfur atom; or the magenta coupler may be a dimer or a polymer connected through $R^{11}$, $R^{12}$ or X.

2. The silver halide color photographic material as described in claim 1, wherein said compound is adenine, guanine or uracil.

3. The silver halide color photographic material as described in claim 1, wherein said compound is selected from the group consisting of ribonucleic acid, adenine, guanine and combinations thereof.

4. The silver halide color photographic material as described in claim 1, wherein said compound is adenine.

5. The silver halide color photographic material as described in claim 1, wherein said compound is included in an amount of 20 mg or more per mol of silver halide.

6. The silver halide color photographic material as described in claim 1, wherein the magenta coupler is selected from the coupler represented by formula, (V).

7. The silver halide color photographic material as described in claim 1, wherein the magenta coupler is selected from the coupler represented by formula (VI).

8. The silver halide color photographic material as described in claim 1, wherein $R^{11}$ and R12 are selected from the group consisting of a hydrogen atom, alkyl group, aryl group, acylamino group and alkylthio group.

9. The silver halide color photographic material as described in claim 1, wherein said compound is added to the silver halide emulsion at the time of forming the silver halide particles, at the time of physical ripening or at the time of chemical ripening.

10. The silver halide color photographic material as described in claim 1, wherein the silver chlorobromide or silver chloroiodobromide contains at least 1 mol % of silver chloride.

11. The silver halide color photographic material as described in claim 1, wherein the magenta coupler represented by Formula (V) or Formula (VI) are included in an emulsion layer in an amount of from $1\times10^{-3}$ mol to 1 mol per mol of silver halide in the same layer.

12. The silver halide color photographic material as described in claim 1, further comprising a silver halide emulsion layer containing a cyan coupler and a silver halide emulsion layer containing a yellow coupler.

13. A silver halide color photographic material comprising a support and at least one silver halide emulsion layer disposed on said support, wherein said emulsion layer contains at least one type of magenta coupler from a pyrazoloazole system represented by Formula (V) or (VI) below, and said silver halide emulsion is a silver chlorobromide emulsion or a silver chloroiodobromide emulsion which is chemically sensitized in the presence of at least one compound selected from the group consisting of deoxyribonucleic acid, ribonucleic acid, decomposition products of deoxyribonucleic acid and decomposition products of ribonucleic acid prior to the completion of chemical sensitization by sulfur compounds:

Formula(V):

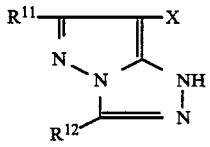

Formula(VI):

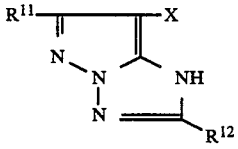

wherein $R^{11}$ and $R^{12}$, which may be the same or different from each other, independently represent a hydrogen atom, halogen atom, alkyl group, aryl group, heterocyclic group, cyano group, alkoxyl group, aryloxy group, heterocyclic oxy group, acyloxy group, carbamoyloxy group, silyloxy group, sulfonyloxy group, acylamino group, anilino group, ureido group, imido group, sulfamoylamino group, carbamoylamino group, alkylthio group, arylthio group, heterocyclic thio group, alkoxycarbonylamino group, aryloxycarbonylamino group, sulfonamido group, carbamoyl group, acyl group, sulfamoyl group, sulfonyl group, sulfinyl group, alkoxycarbonyl group, and aryloxycarbonyl group; and X represents a hydrogen atom, halogen atom, carboxyl group, or a coupling split-off group connected through an oxygen atom, nitrogen atom, or sulfur atom; or the magenta coupler may be a dimer or a polymer connected through $R^{11}$, $R^{12}$ or X.

* * * * *